US011749901B2

(12) United States Patent
Chang et al.

(10) Patent No.: US 11,749,901 B2
(45) Date of Patent: Sep. 5, 2023

(54) HYBRID ANTENNA STRUCTURE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/700,112

(22) Filed: Mar. 21, 2022

(65) Prior Publication Data

US 2023/0096014 A1 Mar. 30, 2023

(30) Foreign Application Priority Data

Sep. 24, 2021 (TW) ..... 110135497

(51) Int. Cl.

| | |
|---|---|
| ***H01Q 1/24*** | (2006.01) |
| ***H01Q 1/44*** | (2006.01) |
| ***H01Q 19/02*** | (2006.01) |
| ***H01Q 21/28*** | (2006.01) |
| ***H01Q 1/36*** | (2006.01) |

(52) U.S. Cl.

CPC ..... *H01Q 19/021* (2013.01); *H01Q 1/36* (2013.01); *H01Q 1/44* (2013.01); *H01Q 21/28* (2013.01); *H01Q 1/241* (2013.01)

(58) Field of Classification Search

CPC ..... H01Q 1/24; H01Q 1/241; H01Q 1/243; H01Q 1/36; H01Q 1/44; H01Q 5/307; H01Q 5/378; H01Q 5/392; H01Q 21/28

See application file for complete search history.

(56) References Cited

U.S. PATENT DOCUMENTS

| | | | | |
|---|---|---|---|---|
| 8,649,833 | B1 * | 2/2014 | Lee | H04M 1/026 455/82 |
| 10,411,333 | B1 * | 9/2019 | Chang | G06F 1/1698 |
| 2015/0200447 | A1 * | 7/2015 | Tang | H01Q 1/243 343/720 |
| 2016/0087343 | A1 * | 3/2016 | Chang | H01Q 9/42 343/720 |
| 2017/0160416 | A1 * | 6/2017 | Juan | H01Q 9/42 |

(Continued)

FOREIGN PATENT DOCUMENTS

| | | |
|---|---|---|
| TW | 201613173 A | 4/2016 |
| TW | 202010177 A | 3/2020 |
| TW | I734468 B | 7/2021 |

OTHER PUBLICATIONS

Chinese language office action dated Jul. 6, 2022, issued in application No. TW 110135497.

*Primary Examiner* — Thai Pham
(74) *Attorney, Agent, or Firm* — McClure, Qualey & Rodack, LLP

(57) ABSTRACT

A hybrid antenna structure includes a first metal element, a second metal element, a third metal element, a cable, and a proximity sensor. The first metal element has a feeding point. The second metal element is adjacent to and separate from the first metal element. A coupling gap is formed between the second metal element and the first metal element. The third metal element is coupled to a connection point on the second metal element. The proximity sensor is coupled through the cable to the third metal element. The second metal element and the third metal element are used as both a sensing pad and a radiation element.

12 Claims, 5 Drawing Sheets

(56) References Cited

U.S. PATENT DOCUMENTS

| | | | | |
|---|---|---|---|---|
| 2021/0075085 | A1* | 3/2021 | Chang | H01Q 1/52 |
| 2021/0167491 | A1* | 6/2021 | Chang | H01Q 1/48 |
| 2021/0351509 | A1 | 11/2021 | Lin et al. | |

* cited by examiner

HYBRID ANTENNA STRUCTURE

CROSS REFERENCE TO RELATED APPLICATIONS

This application claims priority of Taiwan Patent Application No. 110135497 filed on Sep. 24, 2021, the entirety of which is incorporated by reference herein.

BACKGROUND OF THE INVENTION

Field of the Invention

The disclosure generally relates to a hybrid antenna structure, and more particularly, it relates to a hybrid antenna structure with the functions of a radiation element and a sensing pad.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna is a necessary component of a mobile device with a wireless communication function. In order to comply with the government's SAR (Specific Absorption Rate) specification, designers usually add a P-sensor (Proximity Sensor) to the mobile device to control the RF (Radio Frequency) power of the antenna. However, the sensing pad of the P-sensor is likely to negatively affect the antenna and reduce the radiation efficiency of the antenna. As a result, there is a need to propose a novel solution for solving the problems of the prior art.

BRIEF SUMMARY OF THE INVENTION

In an exemplary embodiment, the disclosure is directed to a hybrid antenna structure that includes a first metal element, a second metal element, a third metal element, a cable, and a proximity sensor. The first metal element has a feeding point. The second metal element is adjacent to and separate from the first metal element. A coupling gap is formed between the second metal element and the first metal element. The third metal element is coupled to a connection point on the second metal element. The proximity sensor is coupled through the cable to the third metal element. The second metal element and the third metal element are used as both a sensing pad and a radiation element.

In some embodiments, the first metal element substantially has an L-shape.

In some embodiments, the combination of the second metal element and the third metal element substantially has a T-shape.

In some embodiments, the connection point is adjacent to the central portion of the second metal element.

In some embodiments, the hybrid antenna structure covers a first frequency band and a second frequency band. The first frequency band is from 2400 MHz to 2500 MHz. The second frequency band is from 5150 MHz to 5850 MHz.

In some embodiments, the length of the first metal element is substantially equal to 0.25 wavelength of the second frequency band.

In some embodiments, the length of the second metal element is substantially equal to 0.5 wavelength of the first frequency band.

In some embodiments, the length of the third metal element is substantially equal to 0.25 wavelength of the first frequency band.

In some embodiments, the third metal element includes a meandering portion and a straight-line portion.

In some embodiments, the length of the meandering portion of the third metal element is longer than or equal to 0.125 wavelength of the first frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
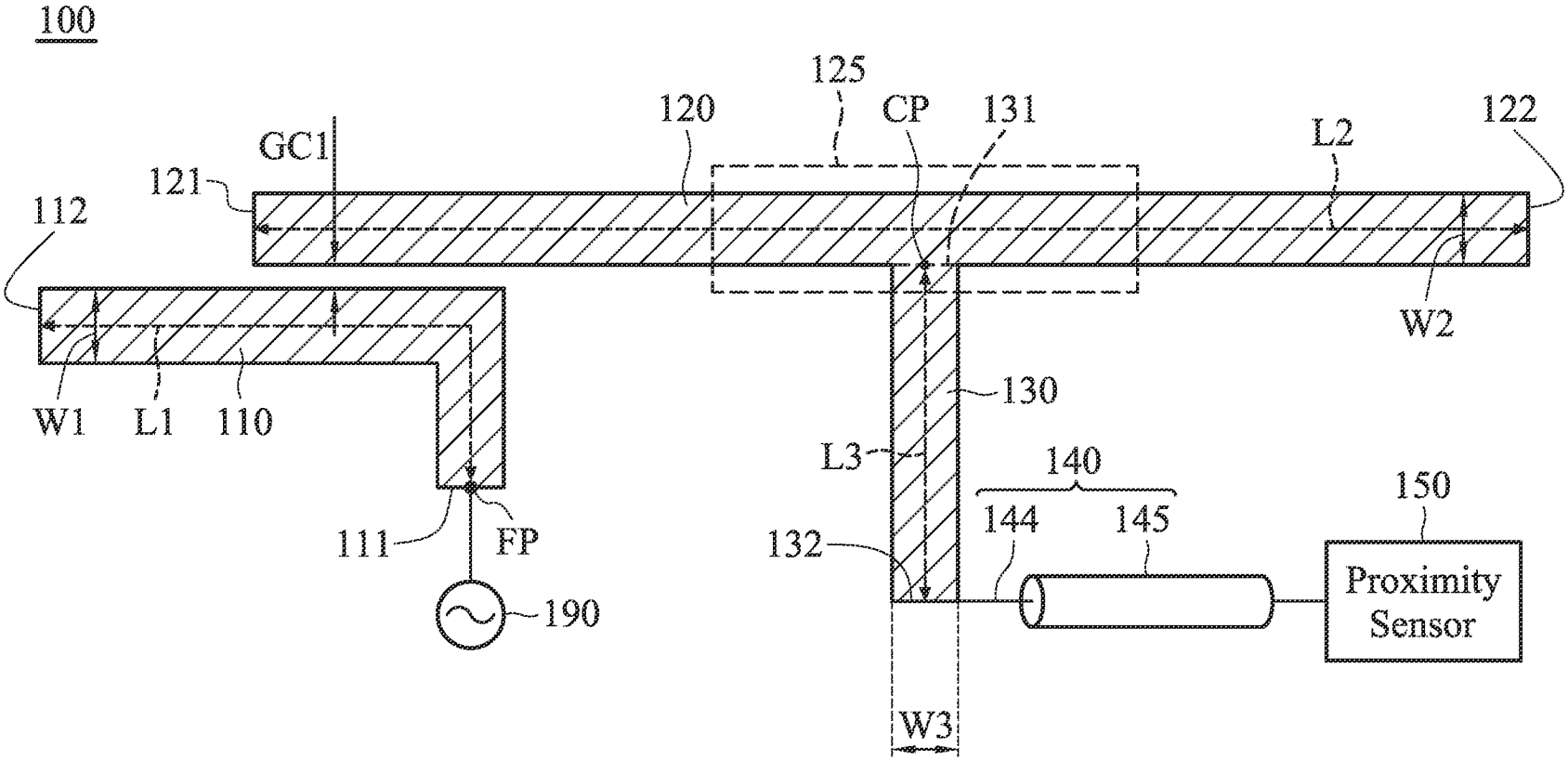
FIG. 1 is a diagram of a hybrid antenna structure according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of a hybrid antenna structure 100 according to an embodiment of the invention. The hybrid antenna structure 100 may be applied in a mobile device, such as a smartphone, a tablet computer, or a notebook computer. As shown in FIG. 1, the hybrid antenna structure 100 includes a first metal element 110, a second metal element 120, a third metal element 130, a cable 140, and a proximity sensor (P-sensor) 150. For example, each of the aforementioned metal elements may be made of copper, silver, aluminum, iron, or their alloys, but it is not limited thereto.

The first metal element 110 may substantially have an L-shape. Specifically, the first metal element 110 has a first end 111 and a second end 112. A feeding point FP is positioned at the first end 111 of the first metal element 110. The second end 112 of the first metal element 110 is an open end. The feeding point FP may be further coupled to a signal source 190. For example, the signal source 190 may be an RF (Radio Frequency) module for exciting the hybrid antenna structure 100.

The second metal element 120 may substantially have a relatively long straight-line shape. The second metal element 120 is adjacent to the first metal element 110, and it is completely separate from the first metal element 110. A coupling gap GC1 is formed between the second metal element 120 and the first metal element 110. Specifically, the second metal element 120 has a first end 121 and a second end 122, which may be two open ends away from each other. For example, the first end 121 of the second metal element 120 and the second end 112 of the first metal element 110 may substantially extend in the same direction. The second end 122 of the second metal element 120 and the second end 112 of the first metal element 110 may substantially extend in opposite directions.

The third metal element 130 may substantially have a relatively short straight-line shape, and it may be substantially perpendicular to the second metal element 120. In some embodiments, the combination of the second metal element 120 and the third metal element 130 may substantially has a T-shape. Specifically, the third metal element 130 has a first end 131 and a second end 132. The first end 131 of the third metal element 130 is coupled to a connection point CP on the second metal element 120. For example, the connection point CP may be adjacent to a central portion 125 of the second metal element 120. Alternatively, the connection point CP may be exactly positioned at the central point of the second metal element 120. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0).

The cable 140 may be a coaxial cable, and it includes a central conductive line 144 and a conductive housing 145. For example, the central conductive line 144 of the cable 140 may be coupled to the second end 132 of the third metal element 130, and the conductive housing 145 of the cable 140 may be coupled to a ground voltage. The proximity sensor 150 is coupled through the cable 140 to the third metal element 130.

It should be noted that the second metal element 120 and the third metal element 130 can be used as a sensing pad of the proximity sensor 150, and they can also be used as a radiation element of the hybrid antenna structure 100. Since the sensing pad is integrated with the radiation element in the hybrid antenna structure 100, the total size of the hybrid antenna structure 100 can be significantly reduced. On the other hand, an equivalent capacitor can be formed between the second metal element 120 (e.g., radiation element) and the first metal element 110 (e.g., radiation element). Thus, the hybrid antenna structure 100 does not need to use an additional DC (Direct Current) block element, and its total manufacturing cost can be effectively decreased.

Figure 2:
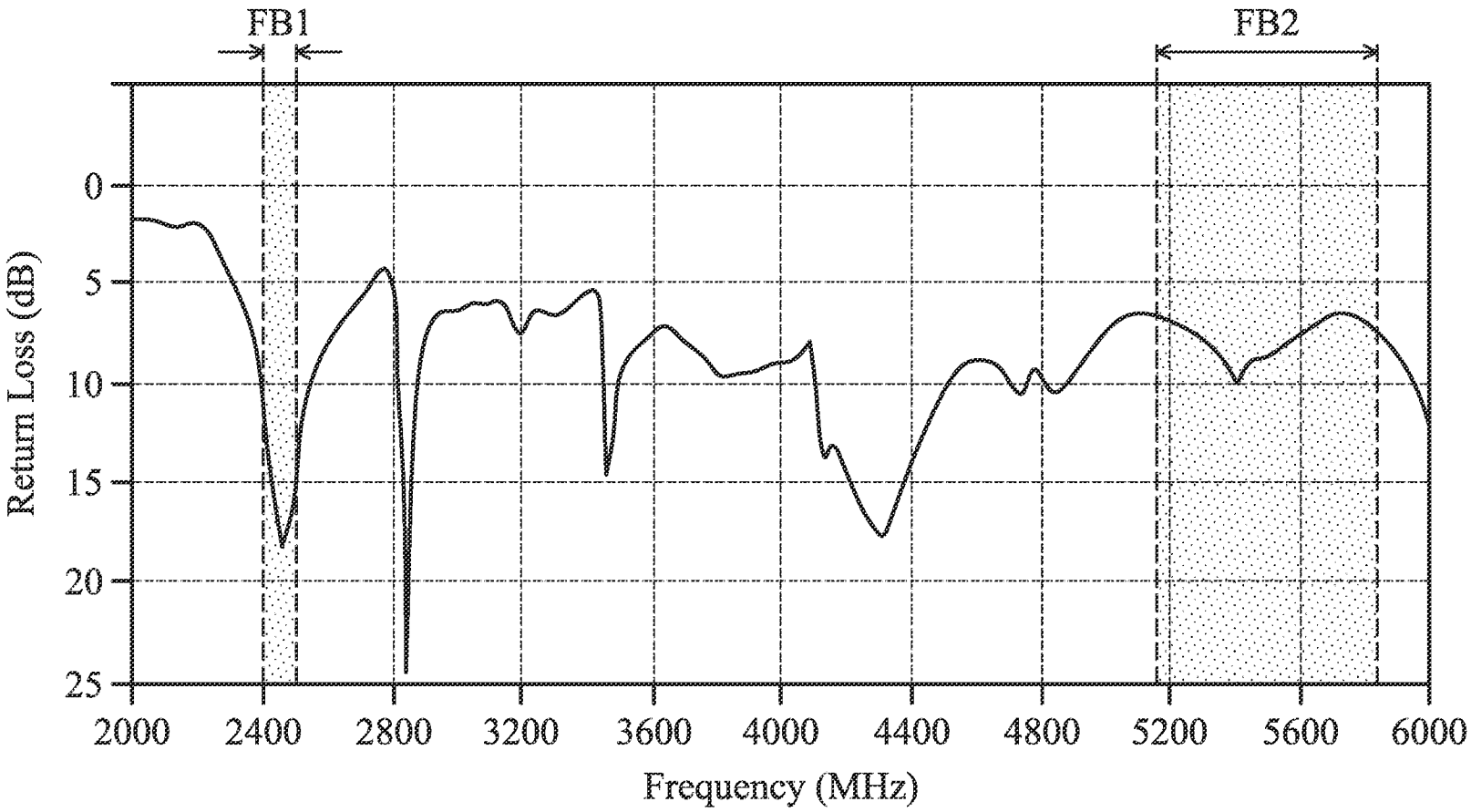
FIG. 2 is a diagram of return loss of a hybrid antenna structure according to an embodiment of the invention.

FIG. 2 is a diagram of return loss of the hybrid antenna structure 100 according to an embodiment of the invention. The horizontal axis represents the operational frequency (MHz), and the vertical axis represents the return loss (dB). As shown in FIG. 2, the hybrid antenna structure 100 can cover a first frequency band FB1 and a second frequency band FB2. The first frequency band FB1 may be from 2400 MHz to 2500 MHz. The second frequency band FB2 may be from 5150 MHz to 5850 MHz. Therefore, the hybrid antenna structure 100 can support at least the wideband operations of WLAN (Wireless Local Area Networks) 2.4 GHz/5 GHz.

In some embodiments, the operational principles of the hybrid antenna structure 100 are described below. The second metal element 120 is excited by the first metal element 110 using a coupling mechanism, so as to generate the first frequency band FB1. The first metal element 110 is excited independently, so as to generate the second frequency band FB2. According to the practical measurement, when being excited by the signal source 190, a current null of the hybrid antenna structure 100 may be exactly positioned at the second end 132 of the third metal element 130. Therefore, even if the cable 140 and the proximity sensor 150 are directly coupled to the third metal element 130, they will not negatively affect the radiation performance of the hybrid antenna structure 100. In addition, when a human body is adjacent to the hybrid antenna structure 100, a virtual capacitor can be formed by the human body and the sensing pad, which is formed by the second metal element 120 and the third metal element 130. By analyzing the capacitance of the virtual capacitor, the proximity sensor 150 can estimate a distance to the human body, and therefore it can control the RF power relative to the hybrid antenna structure 100 and reduce the SAR (Specific Absorption Rate) thereof.

Figure 3:
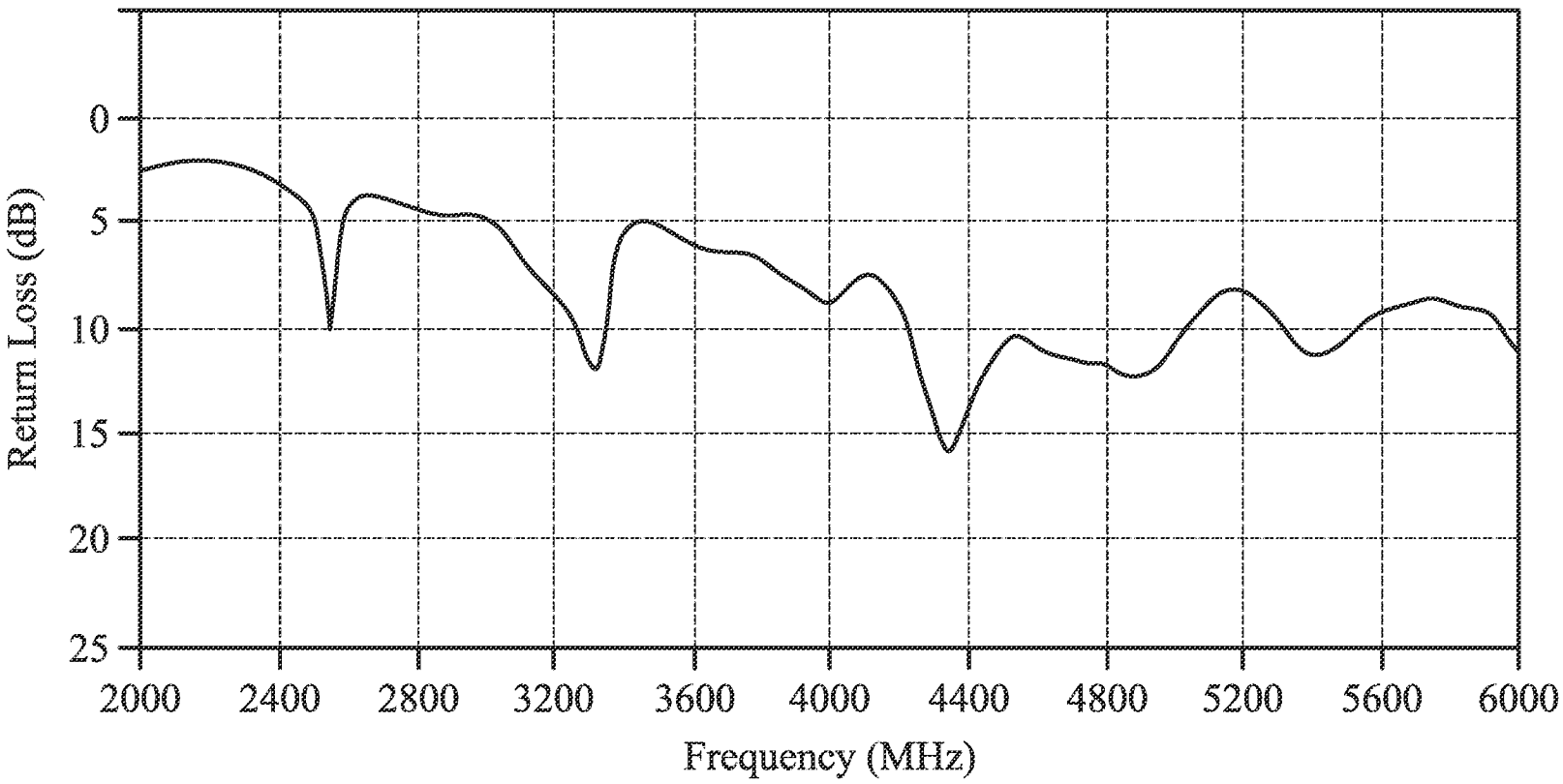
FIG. 3 is a diagram of return loss of a conventional hybrid antenna structure.

FIG. 3 is a diagram of return loss of a conventional hybrid antenna structure. The horizontal axis represents the operational frequency (MHz), and the vertical axis represents the return loss (dB). According to the comparison between FIG. 2 and FIG. 3, if a proximity sensor and a cable are added, the conventional hybrid antenna structure may face problems with the low-frequency resonant mode being destroyed. That is, the conventional hybrid antenna structure cannot cover the aforementioned first frequency band FB1. Accordingly, the invention can overcome the main drawback of the conventional hybrid antenna structure by appropriately designing the first metal element 110, the second metal element 120, and the third metal element 130.

In some embodiments, the element sizes of the hybrid antenna structure 100 are described below. The length L1 of the first metal element 110 may be substantially equal to 0.25 wavelength (λ/4) of the second frequency band FB2 of the hybrid antenna structure 100. The width W1 of the first metal element 110 may be from 1 mm to 2 mm. The length L2 of the second metal element 120 may be substantially equal to 0.5 wavelength (λ/2) of the first frequency band FB1 of the hybrid antenna structure 100. The width W2 of the second metal element 120 may be from 1 mm to 2 mm. The length L3 of the third metal element 130 may be substantially equal to 0.25 wavelength (λ/4) of the first frequency band FB1 of the hybrid antenna structure 100. The width W3 of the third metal element 130 may be from 1 mm to 2 mm. The width of the coupling gap GC1 may be from 0.5 to 2 mm. The above ranges of element sizes are calculated and obtained according to the results of many experiments, and they help to optimize the operational bandwidth and impedance matching of the hybrid antenna structure 100, and to maximize the detectable distance of the sensing pad of the hybrid antenna structure 100.

Figure 4:
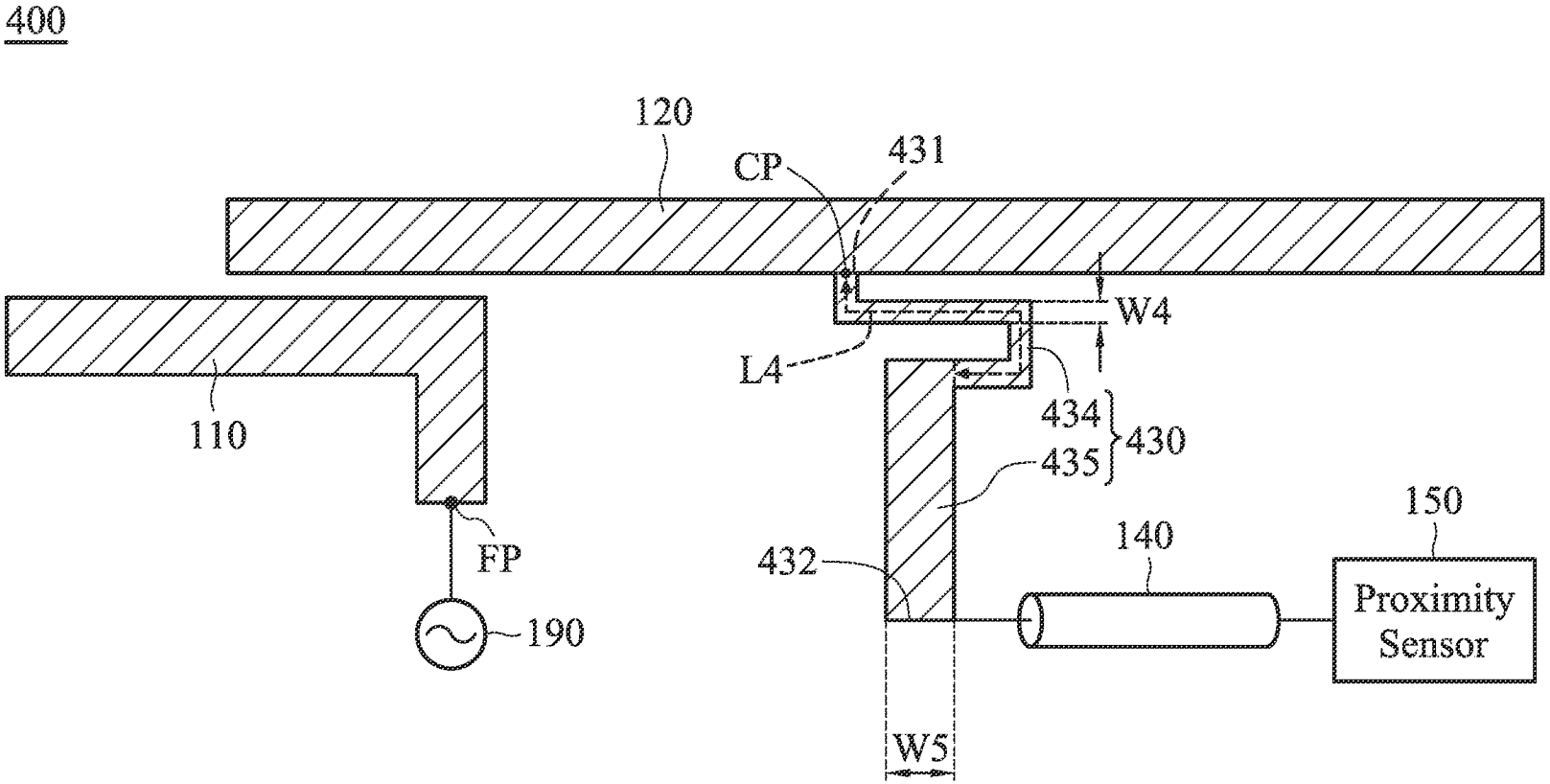
FIG. 4 is a diagram of a hybrid antenna structure according to another embodiment of the invention.

FIG. 4 is a diagram of a hybrid antenna structure 400 according to another embodiment of the invention. FIG. 4 is similar to FIG. 1. In the embodiment of FIG. 4, a third metal element 430 of the hybrid antenna structure 400 includes a meandering portion 434 and a straight-line portion 435 which are coupled to each other. Specifically, the third metal element 430 has a first end 431 and a second end 432. The meandering portion 434 is adjacent to the first end 431 of the third metal element 430. The straight-line portion 435 is adjacent to the second end 432 of the third metal element 430. For example, the meandering portion 434 of the third metal element 430 may include one or more U-shapes or W-shapes which are coupled to each other, but it is not limited thereto. Furthermore, in the third metal element 430, the width W4 of the meandering portion 434 may be smaller than the width W5 of the straight-line portion 435, so as to reduce the total size of the hybrid antenna structure 400.

Figure 5:
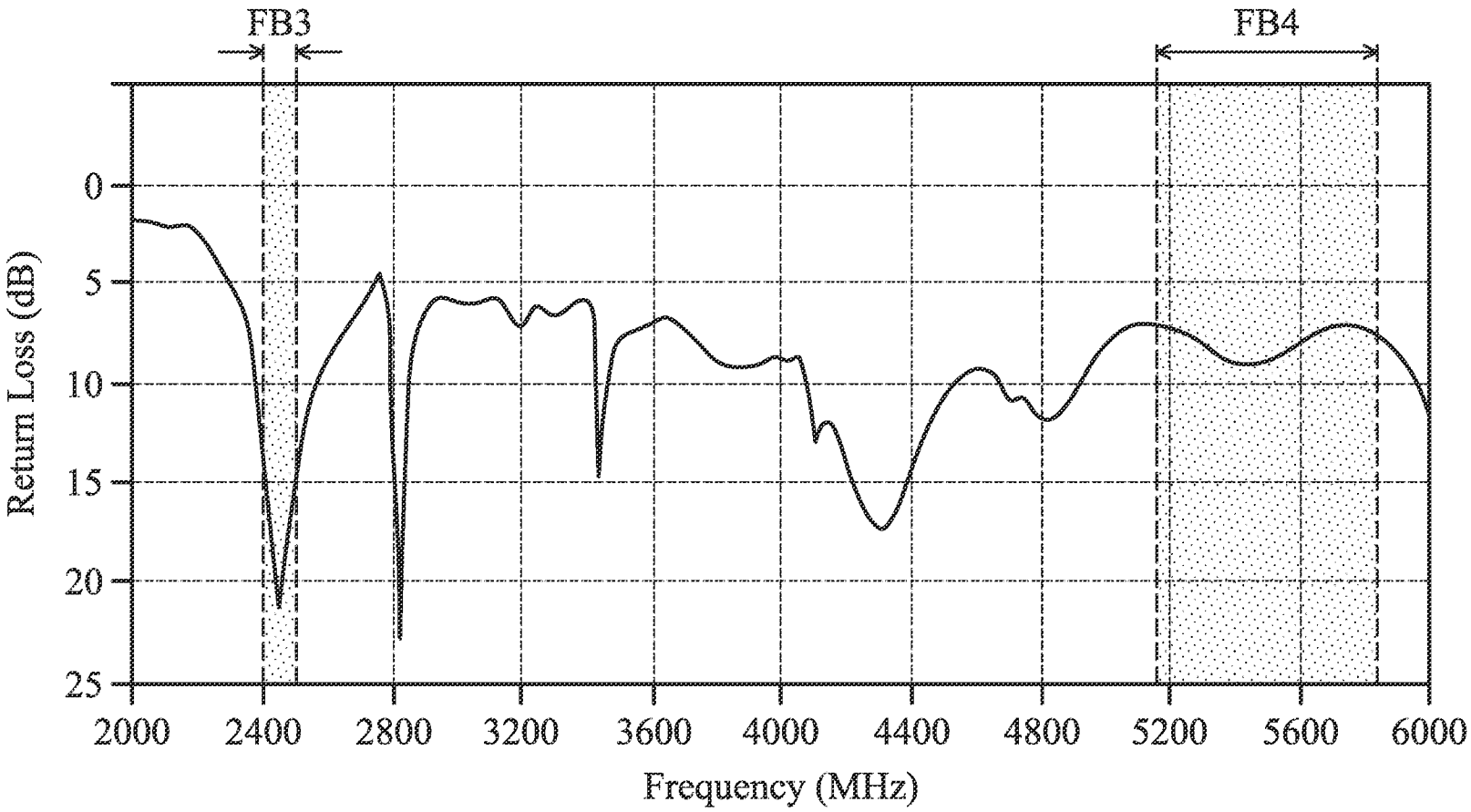
FIG. 5 is a diagram of return loss of a hybrid antenna structure according to another embodiment of the invention.

FIG. 5 is a diagram of return loss of the hybrid antenna structure 400 according to another embodiment of the invention. The horizontal axis represents the operational frequency (MHz), and the vertical axis represents the return loss (dB). As shown in FIG. 5, the hybrid antenna structure 400 can cover a first frequency band FB3 and a second frequency band FB4. The first frequency band FB3 may be from 2400 MHz to 2500 MHz. The second frequency band FB4 may be from 5150 MHz to 5850 MHz. In some embodiments, the length L4 of the meandering portion 434 of the third metal element 430 may be longer than or equal to 0.125 wavelength (λ/8) of the first frequency band FB3 of the hybrid antenna structure 400. The width W4 of the meandering portion 434 of the third metal element 430 may be from 0.1 mm to 1 mm. The width W5 of the straight-line portion 435 of the third metal element 430 may be from 1 mm to 2 mm. According to practical measurements, the meandering portion 434 of the third metal element 430 can help to increase the isolation between the second metal element 120 and the cable 140 within the first frequency band FB3. Other features of the hybrid antenna structure 400 of FIG. 4 are similar to those of the hybrid antenna structure 100 of FIG. 1. Therefore, the two embodiments can achieve similar levels of performance.

The invention proposes a novel hybrid antenna structure, which can effectively integrate a sensing pad with a radiation element. According to practical measurements, the invention can improve the operational performance of the antenna structure and increase the probability of passing the SAR test. Therefore, it is suitable for application in various miniaturized mobile communication devices.

Note that the above element sizes, element shapes, and frequency ranges are not limitations of the invention. An antenna designer can fine-tune these settings or values according to different requirements. It should be understood that the hybrid antenna structure of the invention is not limited to the configurations of FIGS. 1-5. The invention may merely include any one or more features of any one or more embodiments of FIGS. 1-5. In other words, not all of the features displayed in the figures should be implemented in the hybrid antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A hybrid antenna structure, comprising:

a first metal element, having a feeding point;

a second metal element, disposed adjacent to the first metal element, and separate from the first metal element, wherein a coupling gap is formed between the second metal element and the first metal element;

a third metal element, coupled to a connection point on the second metal element;

a cable; and a proximity sensor, coupled through the cable to the third metal element;

wherein the second metal element and the third metal element are used as both a sensing pad and a radiation element;

wherein the hybrid antenna structure covers a first frequency band and a second frequency band;

wherein the third metal element comprises a meandering portion and a straight-line portion;

wherein a length of the meandering portion of the third metal element is longer than or equal to 0.125 wavelength of the first frequency band.

2. The hybrid antenna structure as claimed in claim 1, wherein the first metal element substantially has an L-shape.

3. The hybrid antenna structure as claimed in claim 1, wherein a combination of the second metal element and the third metal element substantially has a T-shape.

4. The hybrid antenna structure as claimed in claim 1, wherein the connection point is adjacent to a central portion of the second metal element.

5. The hybrid antenna structure as claimed in claim 1, wherein the first frequency band is from 2400 MHz to 2500 MHz, and the second frequency band is from 5150 MHz to 5850 MHz.

6. The hybrid antenna structure as claimed in claim 1, wherein a length of the first metal element is substantially equal to 0.25 wavelength of the second frequency band.

7. The hybrid antenna structure as claimed in claim 1, wherein a length of the second metal element is substantially equal to 0.5 wavelength of the first frequency band.

8. The hybrid antenna structure as claimed in claim 1, wherein a length of the third metal element is substantially equal to 0.25 wavelength of the first frequency band.

9. The hybrid antenna structure as claimed in claim 1, wherein a width of the first metal element is from 1 mm to 2 mm.

10. The hybrid antenna structure as claimed in claim 1, wherein a width of the second metal element is from 1 mm to 2 mm.

11. The hybrid antenna structure as claimed in claim 1, wherein a width of the third metal element is from 1 mm to 2 mm.

12. The hybrid antenna structure as claimed in claim 1, wherein a width of the coupling gap is from 0.5 mm to 2 mm.

* * * * *